US006917765B2

(12) United States Patent
Alegria et al.

(10) Patent No.: US 6,917,765 B2
(45) Date of Patent: Jul. 12, 2005

(54) IMAGING DEVICE ACCESS CONTROL APPARATUS

(75) Inventors: Andrew P. Alegria, Nampa, ID (US); Brett A. Smith, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/104,497

(22) Filed: Mar. 21, 2002

(65) Prior Publication Data

US 2003/0180058 A1 Sep. 25, 2003

(51) Int. Cl.[7] ..... G03G 15/00
(52) U.S. Cl. ..... 399/9; 399/81
(58) Field of Search ..... 399/8, 9, 11, 18, 399/21, 76, 77, 79, 80, 81, 107, 124

(56) References Cited

U.S. PATENT DOCUMENTS 5,358,238 A 10/1994 Mandel et al.
5,505,442 A 4/1996 Chang et al.
5,697,761 A * 12/1997 Morgan et al. ..... 414/790.3
5,752,697 A * 5/1998 Mandel et al. ..... 271/288
5,995,773 A * 11/1999 Awano ..... 399/21
6,125,251 A * 9/2000 Shiraishi et al. ..... 399/124
6,374,067 B1 * 4/2002 Park ..... 399/107

FOREIGN PATENT DOCUMENTS

EP 0241273 10/1987
EP 0550033 7/1993

* cited by examiner

*Primary Examiner*—Hoang Ngo

(57) ABSTRACT

An imaging device access control for restricting access to internally located parts of the imaging device. In one embodiment of the invention, an imaging device includes an access panel hingedly attached to an imaging housing. Access to an interior of the imaging device through an access panel is controlled by an access panel operation restrictor assembly. The access panel operation restrictor assembly includes an access panel operation restrictor and an access panel restrictor release. The panel operation restrictor may include a locking mechanism having a bolt which is selectively engageable with the access panel by operation of a solenoid. In one preferred embodiment of the invention, the access panel operation restrictor assembly is operable from an image forming device control panel. An individual must enter an authorization code or password at the control panel as a precondition to operation of the access panel operation restrictor assembly.

14 Claims, 2 Drawing Sheets

IMAGING DEVICE ACCESS CONTROL APPARATUS

BACKGROUND OF THE INVENTION

1. Technical Field

The present invention relates to imaging devices and more particularly to a mechanism to limit access to components of an imaging device.

2. Background Art

During a cycle wherein an image is formed on a sheet media, media follows an involved print path originating in a paper tray, making one or more passes through an image formation system, and terminating in an output tray or area. The internal elements of the imaging device include fragile and often costly media conveyance mechanisms, imaging and transfer systems, fuser elements, toner cartridges and/or ink cartridges. These parts must be accessible for service, replacement of consumables, and removal of paper jams. Such access is typically provided by doors or panels. These doors and panels allow access by any party to the workings of the imaging device.

In the case of a networked or multi-user imaging device, access is available to many parties in a work area, regardless of training or knowledge. This presents certain problems. Damage to the workings of the imaging device can be caused by improper removal of paper jams. Careful and skilled paper jam removal is especially necessary when a jam occurs in the most delicate areas along the paper path. Additionally, printing consumables, including toner cartridges, require care and knowledge to replace correctly, and can cause considerable damage when improperly manipulated. Printing consumables are also expensive, and should only be replaced when necessary. Also, the electronic workings of a imaging device can be damaged by the accidental discharge of electrostatic energy from within the imaging device or by an untrained user. In any event of imaging device malfunction, even well-meaning users can easily damage an imaging device or waste materials in attempting to fix the problem.

For parties responsible for maintaining imaging device operations, unauthorized or improper access to imaging devices may cause further problems. Recurring imaging device problems may go unnoticed if temporary fixes are effected by users who neglect to notify IT staff. Accurate maintenance records may be difficult to keep. Untrained staff may waste time trying to fix problems instead of using more efficient trained personnel. Output quality and user satisfaction may be diminished by unauthorized access. Finally, IT managers or other responsible parties lose complete control over the quality and operations of units for which they are directly accountable.

Therefore, it may be advantageous to limit general access to the inner workings of a imaging device. It may be advantageous to provide a mechanism for locking access panels or doors at all times. It may also be advantageous to allow access only to authorized parties. There may also be an advantage in allowing keyless entry via a password through the electronic control panel.

SUMMARY OF THE INVENTION

The present invention is directed to an imaging device access control apparatus for restricting access to internally located parts of an imaging device. In one embodiment of the invention, an imaging device includes an access panel hingedly attached to an imaging housing. Access to an interior of the imaging device through the access panel is controlled by an access panel operation restrictor assembly. The imaging device access control apparatus includes an access panel operation restrictor and an access panel restrictor release. The access panel operation restrictor assembly may also include a control device for controlling operation of the access panel restrictor release. In one preferred embodiment of the invention, the access panel operation restrictor includes a locking mechanism having a bolt which is selectively engageable with the access panel by operation of a solenoid. In one preferred embodiment of the invention, the imaging device access control apparatus is operable from an image forming device control panel. In one preferred embodiment of the invention, an operator must enter an authorization code at the control panel as a precondition to operation of the access panel operation restrictor assembly. The imaging device access control apparatus may also include a remote control for operating the access panel restrictor release.

Employing the present invention, an authorized individual may access the inner workings and consumable elements of the imaging device for maintenance, replacement of consumables, or removal of paper jams. Conversely, unauthorized access is prevented. This may allow responsible parties to maintain more direct control over the imaging device and may reduce breakage or damage by unauthorized access. The device and system of the invention may allow for better accounting of maintenance records and requirements and may enhance efficiency of maintenance.

In one embodiment of the invention, imaging device control software may be programmed to include password protection for some or all features or functions. An individual may access the inner workings and consumable elements of the imaging device only after entering a password or access code into the control device for authorizing operation of the access panel operation restrictor assembly. Alternately, for an imaging device that is connected to a network, the access panel restrictor release may be remotely operable from a processing device, operable for instance by a system administrator. In the described manner, access then can be achieved at the imaging device with a password or over the network by an authorized user or group of users. Additional remote access features are to be deemed to be within the scope of this disclosure. For instance, IT managers may be able to grant access to individuals on over a network connection without physically visiting the printer.

The present invention consists of the device hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

DETAILED DESCRIPTION

Figure 1:
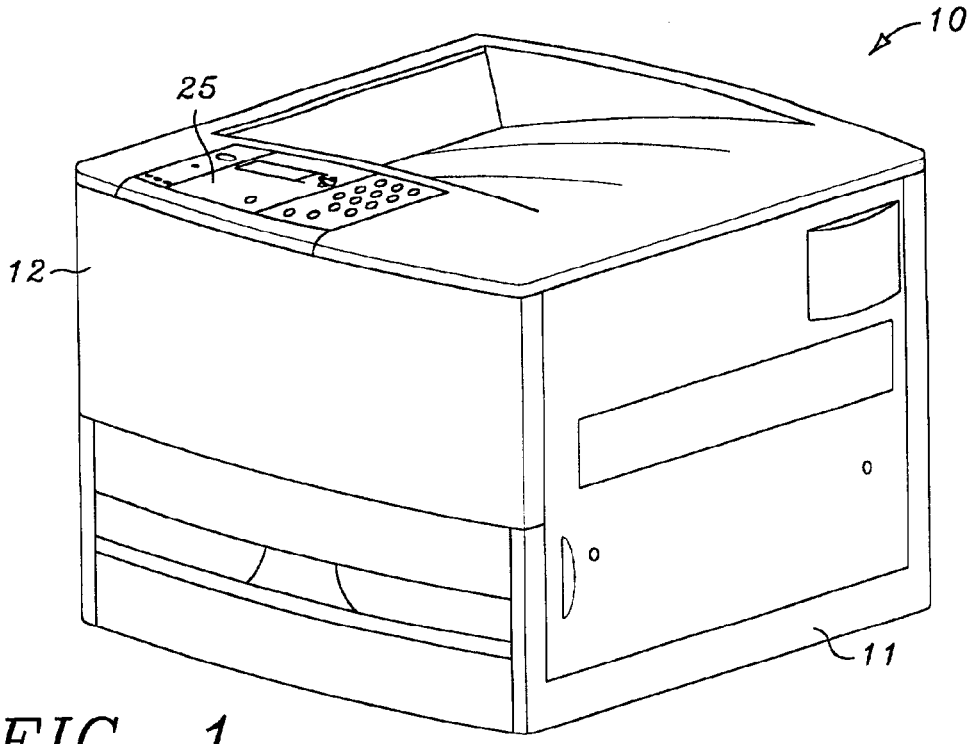
FIG. 1 is a perspective representation showing an imaging device.
Figure 2:
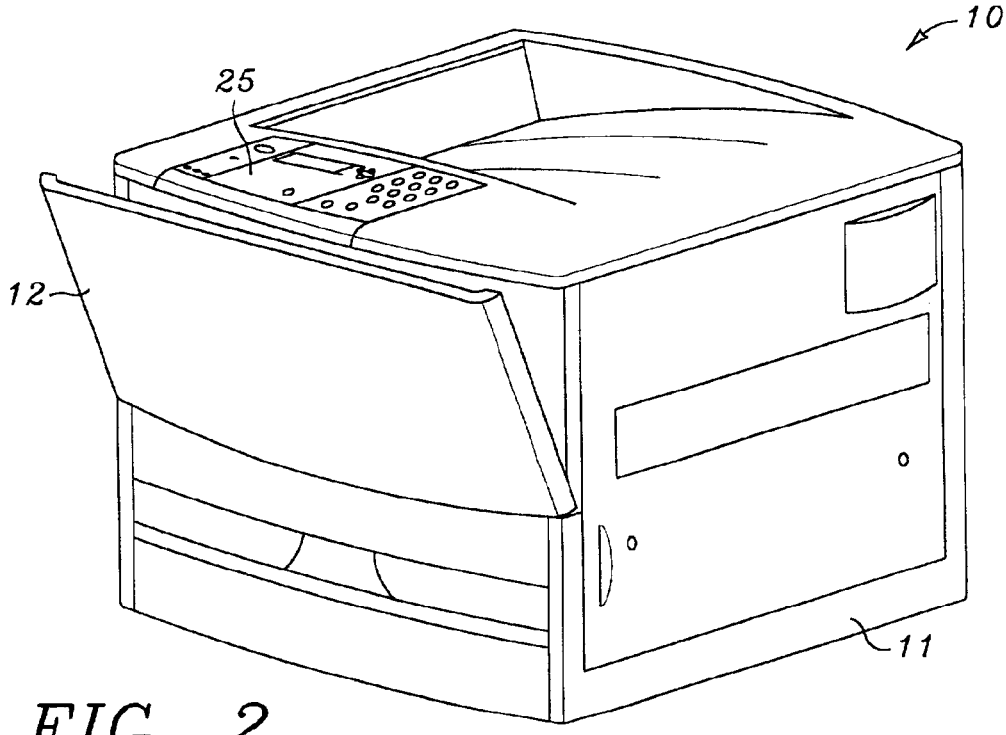
FIG. 2 is a perspective representation showing an imaging device.

Referring to FIGS. 1 and 2, image forming device 10 includes housing 11 having access panel 12 hingedly connected to housing 11. Control panel 25 is shown located on a face of housing 11.

Figure 3:
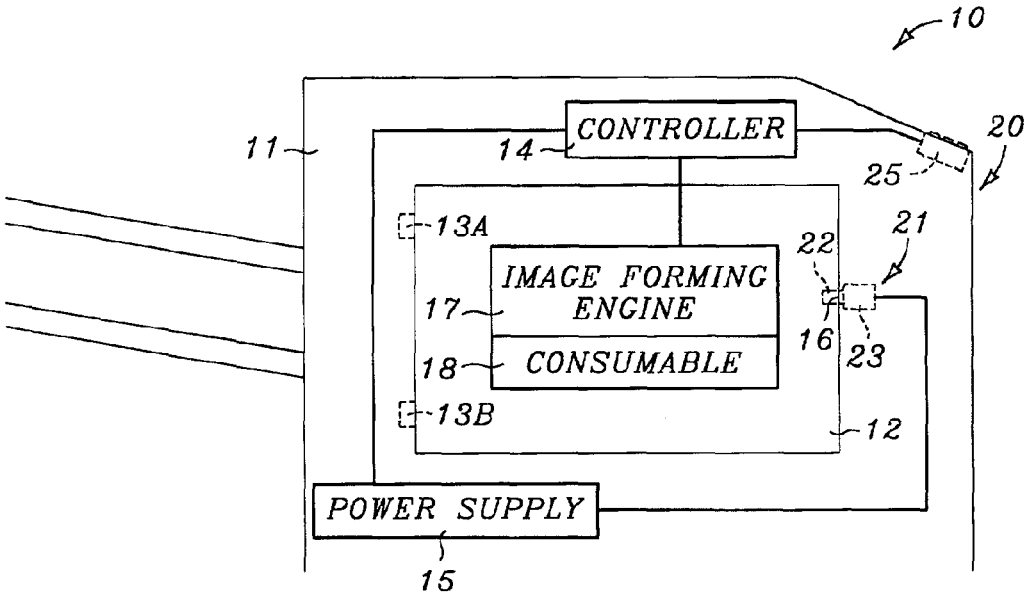
FIG. 3 is a schematic representation showing an imaging device including an imaging device access control.
Figure 4:
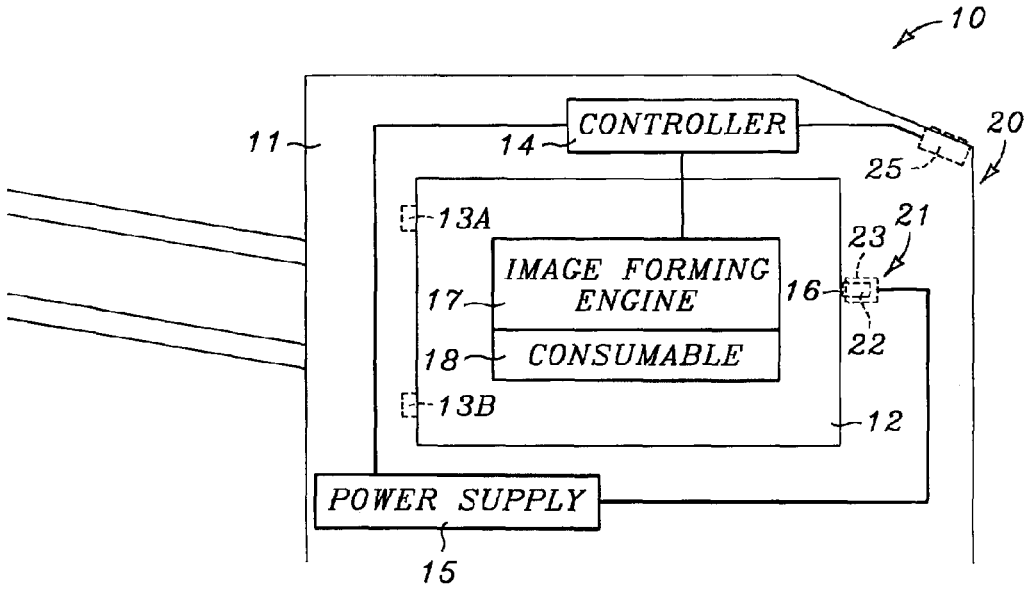
FIG. 4 is a schematic representation showing an imaging device including an imaging device access control.

As shown in FIGS. 3 and 4, image forming device 10 includes housing 11 having access panel 12 hingedly connected to housing 11 by hinges 13A and 13B. Enclosed within housing 11 is controller 14 for controlling various functions of image forming device 10. Power supply 15 provides power to various systems and circuits of image forming device 10 including image forming engine 17. Image forming engine 17 may include any of a variety of image forming assemblies including consumable 18 well known to those skilled in the art.

Operation of access panel 12 is restricted by panel operation restrictor assembly 20. In one preferred embodiment of the invention, panel operation restrictor assembly 20 includes locking mechanism 21 having bolt 22 which is selectively engageable with access panel 12 by operation of solenoid 23. FIG. 3 shows bolt 22 extending beyond edge 16 of access panel 12 thereby restricting the operation of access panel 12. Conversely, FIG. 4 shows bolt 22 retracted within edge 16 by operation of solenoid 23 thereby permitting operation of access panel 12. Image forming device 10 includes control panel 25 shown located on a face of housing 11. Control panel 25 is conductively connected to controller 14. An operator may control various operations and operation parameters from control panel 25. In one preferred embodiment of the invention, panel operation restrictor assembly 20 is operable from control panel 25. In one preferred embodiment of the invention, an operator must enter an authorization code at control panel 25 as a precondition to operation of panel operation restrictor assembly 20.

While this invention has been described with reference to the detailed embodiments, this is not meant to be construed in a limiting sense. Various modifications to the described embodiments as well as the inclusion or exclusion of additional embodiments will be apparent to persons skilled in the art upon reference any such modifications or embodiments as fall within the true scope of the invention.

What is claimed is:

1. An imaging device access control apparatus for controlling access to an interior of the imaging device through an access panel, the imaging device access control apparatus comprising:

an access panel operation restrictor assembly connected to the imaging device for restrictive cooperation between the access panel and an imaging device housing having an image forming engine therein; and a user directable control device operatively connected to the access panel operation restrictor assembly for selectively opening the access panel operation restrictor assembly for allowing access to the interior of the imaging device housing.

2. The imaging device access control apparatus of claim 1 wherein the access panel operation restrictor assembly further comprises:

an access panel operation restrictor selectively engageable between the access panel and the imaging device housing; and a restrictor release member for disengaging the access panel operation restrictor.

3. The imaging device access control apparatus of claim 2 wherein the access panel operation restrictor further comprises a bolt selectively engageable with the access panel.

4. The imaging device access control apparatus of claim 2 wherein the restrictor release member further comprises a solenoid for selectively operating the panel operation restrictor.

5. The imaging device access control apparatus of claim 1 further comprising a control device operatively connected to the access panel operation restrictor assembly for selectively controlling operation of the access panel operation restrictor assembly.

6. The imaging device access control apparatus of claim 1 further comprising:

an access code programmable into the control device for authorizing operation of the access panel operation restrictor.

7. An imaging device comprising:

an imaging device housing defining an imaging device interior;

a power supply positioned within the housing;

a controller connected to the power supply and positioned within the housing;

an image forming engine connected to the controller and positioned within the housing;

an access panel hingedly attached to the imaging device housing;

an imaging device access control apparatus for controlling access to the interior of the imaging device housing through the access panel, the imaging device access control comprising an access panel operation restrictor assembly connected to the imaging device for restrictive cooperation between the access panel and an imaging device housing; and a user directable control device operatively connected to the access panel operation restrictor assembly for selectively opening the access panel operation restrictor assembly for allowing access to the interior of the imaging device.

8. The imaging device access control apparatus of claim 7 further comprising an imaging device consumable positioned within the interior of the imaging device.

9. The imaging device access control apparatus of claim 7 wherein the access panel operation restrictor assembly further comprises:

an access panel operation restrictor selectively engageable between the access panel and the imaging device housing; and a restrictor release member for disengaging the access panel operation restrictor.

10. The imaging device access control apparatus of claim 7 wherein the access panel operation restrictor further comprises a bolt selectively engageable with the access panel.

11. The imaging device access control apparatus of claim 7 wherein the restrictor release member further comprises a solenoid for selectively operating the panel operation restrictor.

12. The imaging device access control apparatus of claim 7 further comprising a control device operatively connected to the access panel operation restrictor assembly for selectively controlling operation of the access panel operation restrictor assembly.

13. The imaging device access control apparatus of claim 7 further comprising:

an access code programmable into the control device for authorizing operation of the access panel operation restrictor.

14. An imaging device comprising:

an imaging device housing containing an image forming assembly;

an access panel attached to the imaging device housing;

an access panel operation restrictor including a bolt selectively engageable between the access panel and the imaging device housing;

a restrictor release member including a solenoid for selectively operating the panel operation restrictor for disengaging the access panel operation restrictor;

a user directable control device operatively connected to the access panel operation restrictor assembly for selectively controlling operation of the access panel operation restrictor assembly for allowing access to an interior of the imaging device housing; and an access code programmable into the control device for authorizing operation of the access panel operation restrictor assembly.

* * * * *